US006458754B1

(12) United States Patent
Velazquez et al.

(10) Patent No.: US 6,458,754 B1
(45) Date of Patent: Oct. 1, 2002

(54) ENCAPSULATED PERFUME PARTICLES AND DETERGENT COMPOSITIONS CONTAINING SAID PARTICLES

(75) Inventors: Jose Maria Velazquez, Estado (MX); Gabriela Marmolejo Rivas, Mexico D.F. (MX); Rodolfo Gilberto RiosDiaz, Mexico D.F., C.P. (MX); Aide Beltran Alvarez, Amp. Isidro Fabela. C.P. (MX); Edgar Manuel Marin, Bosques de Las Lomas (MX); Mark William Glogowski, Atizapan de Zaragoza (MX)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/673,601

(22) PCT Filed: Apr. 16, 1999

(86) PCT No.: PCT/IB99/00687

§ 371 (c)(1),
(2), (4) Date: Oct. 18, 2000

(87) PCT Pub. No.: WO99/55819

PCT Pub. Date: Nov. 4, 1999

Related U.S. Application Data

(60) Provisional application No. 60/082,725, filed on Apr. 23, 1998.

(51) Int. Cl.[7] ..... C11D 11/00; C11D 3/22; C11D 3/50

(52) U.S. Cl. ..... 510/441; 510/101; 510/441; 510/471; 510/349; 510/444; 512/4

(58) Field of Search ..... 512/4; 510/101, 510/441, 471, 444, 349

(56) References Cited

U.S. PATENT DOCUMENTS

| | | | | |
|---|---|---|---|---|
| 5,234,610 A | | 8/1993 | Gardlik et al. | 252/8.6 |
| 5,354,559 A | * | 10/1994 | Morehouse | 424/488 |
| 5,500,138 A | | 3/1996 | Bacon et al. | 252/8.8 |
| 5,656,584 A | * | 8/1997 | Angell et al. | 510/441 |

FOREIGN PATENT DOCUMENTS

| | | | |
|---|---|---|---|
| EP | 0 684 301 A2 | 11/1995 | C11D/3/12 |
| WO | WO 97/06235 | 2/1997 | C11D/3/50 |

* cited by examiner

*Primary Examiner*—Mark Kopec
*Assistant Examiner*—Eisa B Elhilo
(74) *Attorney, Agent, or Firm*—Richard S. Echler, Sr.; C. Brant Cook; Kim W. Zerby

(57) ABSTRACT

Modified starch encapsulated High Impact Accord (HIA) perfume particles are disclosed. The particles consist of a modified starch and perfume oil encapsulated by the starch and comprised of at least two HIA perfume ingredients which have a boiling point at 760 mm Hg, of 275° C. of lower, a calculated ClogP of 2.0 or higher, and an odor detection threshold less than or equal to 50 parts per billion (ppb). The encapsulated perfume particles are particularly useful in laundry compositions.

11 Claims, No Drawings

ENCAPSULATED PERFUME PARTICLES AND DETERGENT COMPOSITIONS CONTAINING SAID PARTICLES

This application claims the benefit of provisional application No. 60/082,725, filed Apr. 23, 1998.

FIELD OF THE INVENTION

The present invention relates to encapsulated perfume particles, especially for delivery of high impact accord (HIA) perfume ingredients, and detergent compositions comprising these encapsulated perfume particles, especially granular detergents.

BACKGROUND OF THE INVENTION

Most consumers have come to expect scented detergent products and to expect that fabrics and other items which have been laundered with these products also have a pleasing fragrance. In many parts of the world handwashing is the predominant means of laundering fabrics. When handwashing soiled fabrics the user often comes in contact with the wash solution and is in close proximity to the detergent product used therein. Handwash solutions may also develop an offensive odor upon addition of soiled clothes. Therefore, it is desirable and commercially beneficial to add perfume materials to such products. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume delivery system for use in detergent products which provides long-lasting, storage-stable fragrance to the product, as well as fragrance which masks wet solution odor during use and provides fragrance to the laundered items.

Detergent compositions which contain perfume mixed with or sprayed onto the compositions are well known from commercial practice. Because perfumes are made of a combination of volatile compounds, perfume can be continuously emitted from simple solutions and dry mixes to which the perfume has been added. Various techniques have been developed to hinder or delay the release of perfume from compositions so that they will remain aesthetically pleasing for a longer length of time. To date, however, few of the methods deliver significant fabric and wet solution odor benefits after prolonged storage of the product.

Moreover, there has been a continuing search for methods and compositions which will effectively and efficiently deliver perfume into an aqueous laundry bath providing a relatively strong scent in the headspace just above the solution, then from the laundry bath onto fabric surfaces. Various methods of perfume delivery have been developed involving protection of the perfume through the wash cycle, with subsequent release of the perfume onto fabrics.

One method for delivery of perfume in the wash cycle involves combining the perfume with an emulsifier and water- soluble polymer, forming the mixture into particles, and adding them to a laundry composition, as is described in U.S. Pat. No. 4,209,417, Whyte, issued Jun. 24, 1980; U.S. Pat. No. 4,339,356, Whyte, issued Jul. 13, 1982; and U.S. Pat. No. 3,576,760, Gould et al, issued Apr. 27, 1971. However, even with the substantial work done by industry in this area, a need still exists for a simple, more efficient and effective perfume delivery system which can be mixed with laundry compositions to provide initial and lasting perfume benefits to fabrics which have been treated with the laundry product.

Another problem in providing perfumed products is the odor intensity associated with the products, especially high density granular detergent compositions. As the density and concentration of the detergent composition increase, the odor from the perfume components can become undesirably intense. A need therefore exists for a perfume delivery system which substantially releases the perfume odor during use and thereafter from the dry fabric, but which does not provide an overly-intensive odor to the product itself.

By the present invention it has now been discovered that perfume ingredients, can be selected based on specific selection criteria to maximize impact during and/or after the wash process, while minimizing the amount of ingredients needed in total to achieve a consumer noticeable benefit. Such compositions are desirable not only for their consumer noticeable benefits (e.g., odor aesthetics), but also for their potentially reduced cost through efficient use of lesser amounts of ingredients.

The present invention solves the long-standing need for a simple, effective, storage-stable delivery system which provides surprising odor benefits (especially wet solution odor benefits) during and after the laundering process. Further, encapsulated perfume-containing compositions have reduced product odor during storage of the composition.

SUMMARY OF THE INVENTION

The present invention relates to modified starch encapsulated High Impact Accord ("HIA") perfume particles; said particles comprising a modified starch and HIA perfume oil comprised of at least two HIA perfume ingredients which have a boiling point at 760 mm Hg, of 275° C. or lower, a calculated CLogP of 2.0 or higher, and an odor detection threshold less than or equal to 50 parts per billion (ppb), wherein the perfume ingredients are encapsulated with the modified starch.

The present invention further relates to laundry compositions comprising from about 0.01% to 50% (preferably from about 0.05% to 8.0%; more preferably from about 0.05% to 3.0% and most preferably from about 0.05 to 1.0%) of a perfume particle according to the present invention and in total from about 50% to about 99.99% preferably from about 92% to 99.95%; more preferably from about 97% to 99.95% and most preferably from about 99% to 99.95%) of conventional laundry ingredients selected from the group consisting of surfactants, builders, bleaching agents, enzymes, soil release polymers, dye transfer inhibitors, fillers and mixtures thereof.

All percentages, ratios, and proportions herein are on a weight basis unless otherwise indicated. All documents cited are hereby incorporated by reference in their entirety.

DETAILED DESCRIPTION OF THE INVENTION

The present invention provides perfumed, dry particulate detergent compositions useful for the washing of fabrics having an especially desirable and noticeable odor attributable to a modified starch encapsulated HIA perfume particle. The HIA perfume oil contains at least two HIA perfume ingredients. An HIA perfume ingredient has a boiling point at 760 mm Hg, of 275° C. or lower, a calculated $\log_{10}$ of its octanol/water partition coefficient, P, of about 2 or higher and an odor detection threshold less than or equal to 50 ppb.

The HIA perfume ingredients are selected according to specific selection criteria described in detail hereinafter. The selection criteria further allow the formulator to take advantage of interactions between these agents when incorporated into the modified starch encapsulate to maximize consumer noticeable benefits while minimizing the quantities of ingredients utilized.

It is also preferable to use both free perfume and encapsulated perfume in the same particulate detergent composition, with the two perfumes being either the same, or two different perfumes. Normally, the free perfume provides the product (or container) perfume fragrance, and covers any base product odor, while the encapsulated perfume provides the in-use perfume odor when the detergent composition is diluted into the wash water.

HIA Perfume Oil

The HIA perfume oil comprises HIA perfume ingredients. An HIA perfume ingredient is characterized by its boiling point (B.P.), its octanol/water partition coefficient (P) and its odor detection threshold ("ODT"). The octanol/water partition coefficient of a perfume ingredient is the ratio between its equilibrium concentrations in octanol and in water. An HIA perfume ingredient of this invention has a B.P., determined at the normal, standard pressure of about 760 mm Hg, of about 275° C. or lower, an octanol/water partition coefficient P of about 2,000 or higher, and an ODT of less than or equal to 50 parts per billion (ppb). Since the partition coefficients of the preferred perfume ingredients of this invention have high values, they are more conveniently given in the form of their logarithm to the base 10, logP. Thus the preferred perfume ingredients of this invention have logP of about 2 and higher.

The boiling points of many perfume ingredients, at standard 760 mm Hg are given in, e.g., "Perfume and Flavor Chemicals (Aroma Chemicals)," Steffen Arctander, published by the author, 1969, incorporated herein by reference.

The logP values of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

Odor detection thresholds are determined using a gas chromatograph. The gas chromatograph is calibrated to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 12 seconds, the sampled volume is calculated. Since the precise concentration at the detector at any point in time is known, the mass per volume inhaled is known and hence the concentration of material. To determine whether a material has a threshold below 50 ppb, solutions are delivered to the sniff port at the back-calculated concentration. A panelist sniffs the GC effluent and identifies the retention time when odor is noticed. The average across all panelists determines the threshold of noticeability.

The necessary amount of analyte is injected onto the column to achieve a 50 ppb concentration at the detector. Typical gas chromatograph parameters for determining odor detection thresholds are listed below.

GC: 5890 Series II with FID detector

7673 Autosampler

Column: J&W Scientific DB-1

Length 30 meters ID 0.25 mm film thickness 1 micron

Method:

Split Injection: 17/1 split ratio

Autosampler: 1.13 microliters per injection

Column Flow: 1.10 mL/minute

Air Flow: 345 mL/minute

Inlet Temp. 245° C.

Detector Temp. 285° C.

Temperature Information

Initial Temperature: 50° C.

Rate: 5C/minute

Final Temperature: 280° C.

Final Time: 6 minutes

Leading assumptions:

(i) 12 seconds per sniff (ii) GC air adds to sample dilution

An HIA perfume oil is composed of at least two HIA perfume ingredients, each HIA perfume ingredient having:

(1) a standard B.P. of about 275° C. or lower at 760 mm Hg, and;

(2) a ClogP, or an experimental logP, of about 2 or higher, and;

(3) an ODT of less than or equal to 50ppb and greater than 10 ppb, and is encapsulated in a modified starch as described hereinafter, and used in a particulate detergent cleaning composition. The HiA perfume oil is very effusive and very noticeable when the product is in use as well as on fabric items that come in contact with the wash solution. Of the perfume ingredients in a given perfume oil, at least 40%, preferably at least 50% and most preferably at least 70% are HIA perfume ingredients.

Table 1 gives some non-limiting examples of HIA perfume ingredients.

TABLE 1

HIA Perfume Ingredients

| HIA Ingredient |
|---|
| 4-(2,2,6-Trimethylcyclohex-1-enyl)-2-en-4-one |
| 2,4-Decadienoic acid, ethyl ester (E,Z)- |
| 6-(and -8) isopropylquinoline |
| Acetaldehyde phenylethyl propyl acetal |
| Acetic acid, (2-methylbutoxy)-, 2-propenyl ester |
| Acetic acid, (3-methylbutoxy)-, 2-propenyl ester |
| 2,6,10-Trimethyl-9-undecenal |
| Glycolic acid, 2-pentyloxy-, allyl ester |
| Hexanoic acid, 2-propenyl ester |
| 1-Octen-3-ol |
| trans-Anethole |
| iso buthyl (z)-2-methyl-2-butenoate |
| Anisaldehyde diethyl acetal |
| Benzenepropanal, 4-(1,1-dimethylethyl)- |
| 2,6-Nonadien-1-ol |

TABLE 1-continued

| HIA Perfume Ingredients |
|---|
| 3-methyl-5-propyl-cyclohexen-1-onre |
| Butanoic acid, 2-methyl-, 3-hexenyl ester, (Z)- |
| Acetaldehyde, [(3,7-dimethyl-6-octenyl)oxy]- |
| Lauronitrile |
| 2,4-dimethyl-3-cyclohexene-1-carbaldehyde |
| 2-Buten-1-one, 1-(2,6,6-trimethyl-1,3-cyclohexadien-1-yl)- |
| 2-Buten-1-one, 1-(2,6,6-trimethyl-2-cyclohexen-1-yl)-, (E)- |
| gamma-Decalactone |
| trans-4-decenal |
| decanal |
| 2-Pentylcyclopentanone |
| 1-(2,6,6 Trimethyl 3 Cyclohexen-1-yl)-2 Buten-1-one) |
| 2,6-dimethylheptan-2-ol |
| Benzene, 1,1'-oxybis- |
| 4-Penten-1-one, 1-(5,5-dimethyl-1-cyclohexen-1-yl)- |
| Butanoic acid, 2-methyl-, ethyl ester |
| Ethyl anthranilate |
| 2-Oxabicyclo[2.2.2]octane, 1,3,3-trimethyl- |
| Eugenol |
| 3-(3-isopropylphenyl)butanal |
| methyl 2-octynoate |
| 4-(2,6,6-trimethyl-1-cyclohexen-1-yl__-3-buten-2-one |
| Pyrazine, 2-methoxy-3-(2-methylpropyl)- |
| Quiniline, 6-secondary buty |
| Isoeugenol |
| 2H-Pyran-2-one, tetrahydro-6-(3-pentenyl)- |
| Cis-3-Hexenyl Methyl Carbonate |
| Linalool |
| 1,6,10-Dodecatriene, 7,11-dimethyl-3-methylene-, (E)- |
| 2,6-dimethyl-5-heptenal |
| 4,7 Methanoindan 1-carboxaldehyde, hexahydro |
| 2-methylundecanal |
| methyl 2-nonynonate |
| 1,1-dimethoxy-2,2,5-trimethyl-4-hexene |
| Benzoic acid, 2-hydroxy-, methyl ester |
| 4-Penten-1-one, 1-(5,5-dimethyl-1-cyclohexen-1-yl) |
| 2H-Pyran, 3,6-dihydro-4 methyl-2-(2-methyl-1-propenyl)- |
| 2,6-Octadienenitrile, 3,7-dimethyl-, (Z)- |
| 2,6-nonadienal |
| 6-Nonenal, (Z)- |
| nonanal |
| octanal |
| 2-Nonenenitrile |
| Acetic acid, 4-methylphenyl ester |
| Gamma Undecalactone |
| 2-norpinene-2-propionaldehyde 6,6 dimethyl |
| 4-nonanolide |
| 9-decen-1-ol |
| 2H-Pyran, tetrahydro-4-methyl-2-(2-methyl-1-propenyl)- |
| 5-methyl-3-heptanone oxime |
| Octanal, 3,7-dimethyl- |
| 4-methyl-3-decen-5-ol |
| 10-Undecen-1-al |
| Pyridine, 2-(1-ethylpropyl)- |
| Spiro[furan-2(3H),5'-[4,7]methano[5H]indene], decahydro- |

The following are non-limiting examples of suitable perfume oil compositions for use in the present invention:

EXAMPLE 1

| HIA Perfume Ingredient Trade Name | Conc. Wt. % | ODT | Boiling Point ° C. | ClogP |
|---|---|---|---|---|
| Eugenol | 5 | <50 PPB | 259 | 2.4 |
| Lilial | 15 | <50 PPB | 280 | 3.9 |
| Linalool | 25 | <50 PPB | 197 | 3.0 |
| beta-Naphthyl methyl ether | 5 | <50 PPB | 270 | 3.2 |
| Anisic Aldehyde | 10 | <50 PPB | 249 | 2.0 |
| Flor Acetate | 10 | <50 PPB | 265 | 2.4 |
| Ionone Beta | 10 | <50 PPB | 265 | 3.8 |
| Rose Oxide | 10 | <50 PPB | 201 | 2.9 |

-continued

| HIA Perfume Ingredient Trade Name | Conc. Wt. % | ODT | Boiling Point ° C. | ClogP |
|---|---|---|---|---|
| Damascenone | 5 | <50 PPB | 260 | 4.3 |
| Cyclal C | 5 | <50 PPB | 199 | 2.4 |
| Total | 100 | | | |

EXAMPLE 2

| HIA Perfume Ingredient Trade Name | Conc. Wt. % | ODT | Boiling Point ° C. | ClogP |
|---|---|---|---|---|
| Cyclal C | 10 | <50 PPB | 199 | 2.4 |
| Damascone Alpha | 5 | <50 PPB | 255 | 4.7 |
| Rose Oxide | 10 | <50 PPB | 201 | 2.9 |
| Ionone Beta | 25 | <50 PPB | 265 | 3.8 |
| Cis-3-Hexenyl Salycilate | 15 | <50 PPB | 271 | 4.84 |
| Methyl Octine Carbonate | 5 | <50 PPB | 219 | 3.1 |
| Lilial | 30 | <50 PPB | 280 | 3.9 |
| Total | 100 | | | |

EXAMPLE 3

| HIA Perfume Ingredient Trade Name | Conc. Wt. % | ODT | Boiling Point ° C. | ClogP |
|---|---|---|---|---|
| Damascone Alpha | 5 | <50 PPB | 255 | 4.7 |
| Cyclal C | 5 | <50 PPB | 199 | 2.4 |
| Rose Oxide | 10 | <50 PPB | 201 | 2.9 |
| Ionone Beta | 25 | <50 PPB | 265 | 3.8 |
| Frutene | 15 | <50 PPB | 275 | 2.9 |
| Anisic Aldehyde | 10 | <50 PPB | 249 | 2.0 |
| Ethyl-2-methyl Butyrate | 5 | <50 PPB | 129 | 2.1 |
| Lilial | 25 | <50 PPB | 280 | 3.9 |
| Total | 100 | | | |

Encapsulating Material

The HIA perfume oils are encapsulated with a water soluble, modified starch to form the modified starch encapsulate. Encapsulation of the HIA perfume oils in the water soluble modified starch provides an enhanced fragrance signal during use, when used in detergent compositions.

Starches suitable for encapsulating the perfume oils of the present invention can be made from, raw starch, pregelatinized starch, modified starch derived from tubers, legumes, cereal and grains, for example corn starch, wheat starch, rice starch, waxy corn starch, oat starch, cassava starch, waxy barley, waxy rice starch, sweet rice starch, amioca, potato starch, tapioca starch, oat starch, cassava starch, and mixtures thereof.

Modified starches suitable for use as the encapsulating matrix in the present invention include, hydrolyzed starch, acid thinned starch, starch esters of long chain hydrocarbons, starch acetates, starch octenyl succinate, and mixtures thereof.

The term "hydrolyzed starch" refers to oligosaccharide-type materials that are typically obtained by acid and/or enzymatic hydrolysis of starches, preferably corn starch. Suitable hydrolyzed starches for inclusion in the present invention include maltodextrins and corn syrup solids. The hydrolyzed starches for inclusion with the mixture of starch esters have a Dextrose Equivalent (DE) values of from about 10 to about 36 DE. The DE value is a measure of the reducing equivalence of the hydrolyzed starch referenced to dextrose and expressed as a percent (on a dry basis). The higher the DE value, the more reducing sugars present. A method for determining DE values can be found in Standard Analytical Methods of the Member Companies of Corn Industries Research Foundation, 6th ed. Corn Refineries Association, Inc. Washington, D.C. 1980, D-52.

Starch esters having a degree of substitution in the range of from about 0.01% to about 10.0% may be used to encapsulate the perfume oils of the present invention. The hydrocarbon part of the modifying ester should be from a $C_5$ to $C_{16}$ carbon chain. Preferably, octenylsuccinate (OSAN) substituted waxy corn starches of various types such as 1) waxy starch: acid thinned and OSAN substituted, 2) blend of corn syrup solids: waxy starch, OSAN substituted, and dextrinized, 3) waxy starch: OSAN substituted and dextrinized, 4) blend of corn syrup solids or maltodextrins with waxy starch: acid thinned OSAN substituted, and then cooked and spray dried, 5) waxy starch: acid thinned and OSAN substituted then cooked and spray dried, and 6) the high and low viscosities of the above modifications (based on the level of acid treatment) can also be used in the present invention.

Modified starches having emulsifying and emulsion stabilizing capacity such as starch octenyl succinates have the ability to entrap the perfume oil droplets in the emulsion due to the hydrophobic character of the starch modifying agent. The perfume oils remain trapped in the modified starch until dissolved in the wash solution, due to thermodynamic factors i.e., hydrophobic interactions and stabilization of the emulsion because of steric hindrance.

EXAMPLE 4

Manufacture of Modified Starch Encapsulated HIA Perfume Particles

The following is a non-limiting example of a suitable process for manufacture of a modified starch encapsulated HIA perfume particle for use in detergent compositions according to the present invention.

1. 225 g of CAPSUL modified starch (National Starch & Chemical) is added to 450 g of water at 24° C.
2. The mixture is agitated at 600 RPM (turbine impeller 2 inches in diameter) for 20 minutes.
3. 75 g perfume oil is added near the vortex of the starch solution.
4. The emulsion formed is agitated for an additional 20 minutes (at 600 RPM).
5. Upon achieving a perfume droplet size of less than 15 microns, the emulsion is pumped to a spray drying tower and atomized through a spinning disk with co-current airflow for drying. The inlet air temperature is set at 205–210° C., the exit air temperature is stabilized at 98–103° C.
6. Dried particles of the starch encapsulated perfume oil are collected at the dryer outlet.

Analysis of the finished HIA perfume particle (all % based on weight):

| | |
|---|---|
| Total Perfume Oil | 24.56% |
| Encapsulated Oil | 24.46% |
| Free/Surface Oil | 0.10% |

-continued

| | |
|---|---|
| Starch | 72.57% |
| Moisture | 2.87% |
| Particle Size Distribution | |
| <50 micrometers | 16% |
| 50–500 micrometers | 83% |
| >500 micrometers | 1% |

Other known methods of manufacturing the starch encapsulates of the present invention, include but are not limited to, fluid bed agglomeration, extrusion, cooling/crystallization methods and the use of phase transfer catalysts to promote interfacial polymerization.

When a detergent composition containing the encapsulated HIA perfume particles described herein is added to water the modified starch of the perfume particles begins to dissolve in the water. Not wishing to be bound by theory it is believed that the dissolving modified starch swells and an emulsion of perfume droplets, modified starch and water is formed, the modified starch being the emulsifier and emulsion stabilizer. After the emulsion is formed, the perfume oil begins to coalesce into larger droplets of perfume, which can migrate to either the surface of the solution or to the surface of fabrics in the wash solution due to the relative density difference between the perfume droplets (mostly low density hydrophobic oils) and the wash water. When the droplets reach either interface, they spread out quickly along the surface or interface. The spreading of the perfume droplet at the wash surface increases the surface area from which the perfume oil can volatilize, thereby releasing larger amounts of the perfume into the headspace above the wash solution. This provides a surprisingly strong and consumer noticeable scent in the headspace above the wash solution. When an equal mass of HIA perfume oil is delivered in a granular detergent via HIA particles according to the present invention as opposed to being sprayed on or delivered via cyclodextrin capsules the mass of perfume present in the headspace above the wash solution is ten fold greater. This can be confirmed by collection of the headspace air, from which the delivered perfume is subsequently condensed and its mass determined using conventional gas chromatography. Furthermore, the interaction of the perfume droplets with wet fabrics in solution provides a surprisingly strong and consumer noticeable scent on wet and dry fabrics.

Encapsulation of the HIA perfume oils as described above allows for loading of larger amounts of perfume oil than if they were encapsulated in a native starch granule. Encapsulation of perfume oils using cylodextrin is limited by the particle size of the guest molecule (perfume) and the cavity of the host (cyclodextrin). It is difficult to load more than about 20% perfume into a cyclodextrin particle. However, encapsulation with a starch that has been modified to have emulsion properties does not impose this limitation. Since the encapsulation in the present invention is achieved by entrapping perfume oil droplets of less than 15 microns, preferably less than 5 microns and most preferably less than 2.5 microns in size, within the modified starch matrix, while the matrix is being formed by removal of water from the emulsion, more perfume can be loaded based on the type, method and level of modification of the starch. In contrast, traditional cyclodextrin molecules trap the perfume oil completely inside their cavity thereby limiting the size and amount of the perfume oil encapsulated. Loads much greater than 20% are possible when encapsulating with the modified starches described by this invention.

Encapsulation of the volatile HIA perfume oils also minimizes depletion during storage and when the product container is opened. Further, HIA perfumes are generally only released when detergents containing the encapsulated particle are dissolved in the wash solution. Furthermore, the water soluble encapsulating matrix protects the perfume oil from chemical degradation caused in the neat product as well as in the wash solution, by the different surfactant systems or bleaches which are commonly present in the particulate detergent compositions of this invention.

Other suitable matrix materials and process details are disclosed in, e.g., U.S. Pat. No. 3,971,852, Brenner et al., issued Jul. 27, 1976, which is incorporated herein by reference.

Water soluble perfume microcapsules containing conventional, non-HIA perfume oils can be obtained commercially, e.g., as IN-CAP® from Polak's Frutal Works, Inc., Middletown, N.Y.; and as Optilok System® encapsulated perfumes from Encapsulated Technology, Inc., Nyack, N.Y.

The detergent compositions herein comprise from about 0.01% to 50% of the above described modified starch encapsulated HIA perfume particle. More preferably, the detergent compositions herein comprise from about 0.05% to 8.0% of the HIA perfume particle, even more preferably from about 0.5% to 3.0%. Most preferably, the detergent compositions herein contain from about 0.05% to 1.0% of the encapsulated HIA perfume particle. The encapsulated perfume particles preferably have size of from about 1 micron to about 1000 microns, more preferably from about 50 microns to about 500 microns.

The encapsulated perfume particles are used in compositions with detersive ingredients, as follows.

Optional Detersive Adjuncts

As a preferred embodiment, the conventional detergent ingredients are selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. and in Great Britain Patent Application No. 9705617.0, Trinh et al., published Sep. 24, 1997. Such adjuncts are included in detergent compositions at their conventional art-established levels of use, generally from 0% to about 80% of the detergent ingredients, preferably from about 0.5% to about 20% and can include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, solvents, solubilizing agents, chelating agents, clay soil removal/anti-redeposition agents, polymeric dispersing agents, processing aids, fabric softening components, static control agents, bleaching agents, bleaching activators, bleach stabilizers, etc.

Granular Detergent Composition

The encapsulated perfume particles hereinbefore described can be used in both low density (below 550 grams/liter) and high density granular detergent compositions in which the density of the granule is at least 550 grams/liter or in a laundry detergent additive product. Such high density detergent compositions typically comprise from about 30% to about 90% of detersive surfactant.

Low density compositions can be prepared by standard spray- drying processes. Various means and equipment are available to prepare high density granular detergent compositions. Current commercial practice in the field employs spray-drying towers to manufacture granular laundry detergents which often have a density less than about 500 g/l. Accordingly, if spray drying is used as part of the overall process, the resulting spray-dried detergent particles must be further densified using the means and equipment described hereinafter. In the alternative, the formulator can eliminate spray-drying by using mixing, densifying and granulating equipment that is commercially available.

High speed mixer/densifiers can be used in the present process. For example, the device marketed under the trademark "Lodige CB30" Recycler comprises a static cylindrical mixing drum having a central rotating shaft with mixing/cutting blades mounted thereon. Other such apparatus includes the devices marketed under the trademark "Shugi Granulator" and under the trademark "Drais K-TTP 80". Equipment such as that marketed under the trademark "Lodige KM600 Mixer" can be used for further densification.

In one mode of operation, the compositions are prepared and densified by passage through two mixer and densifier machines operating in sequence. Thus, the desired compositional ingredients can be admixed and passed through a Lodige mixture using residence times of 0.1 to 1.0 minute then passed through a second Lodige mixer using residence times of 1 minute to 5 minutes.

In another mode, an aqueous slurry comprising the desired formulation ingredients is sprayed into a fluidized bed of particulate surfactants. The resulting particles can be further densified by passage through a Lodige apparatus, as noted above. The perfume delivery particles are admixed with the detergent composition in the Lodige apparatus.

The final density of the particles herein can be measured by a variety of simple techniques, which typically involve dispensing a quantity of the granular detergent into a container of known volume, measuring the weight of detergent and reporting the density in grams/liter.

Once the low or high density granular detergent "base" composition is prepared, the encapsulated perfume particles of this invention are added thereto by any suitable dry-mixing operation.

Deposition of Perfume Onto Fabric Surfaces

The method of washing fabrics and depositing perfume thereto comprises contacting said fabrics with an aqueous wash liquor comprising at least about 100 ppm of conventional detersive ingredients described hereinabove, as well as at least about 0.1 ppm of the above-disclosed encapsulated perfume particles. Preferably, the aqueous liquor comprises from about 500 ppm to about 20,000 ppm of the conventional detersive ingredients and from about 10 ppm to about 200 ppm of the encapsulated perfume particles.

The encapsulated perfume particles work under all wash conditions, but they are particularly useful for providing odor benefits to the wet laundry solution during use and on dried fabrics during their storage.

The following nonlimiting examples illustrate the parameters of and compositions employed within the invention. All percentages, parts and ratios are by weight unless otherwise indicated.

| Components | 5 | 6 | 7 | 8 | 9 | 10 | 11 |
|---|---|---|---|---|---|---|---|
| LAS | 21.6 | 18 | 25 | 5 | 0 | 18 | 22 |
| AES | 1.0 | 1.5 | — | — | — | 1.0 | — |
| ADHQ | 0.7 | 0.6 | — | — | — | 0.6 | — |
| AE | — | 0.4 | 0.5 | — | — | — | 0.9 |
| Phosphate | 22 | 13 | 21 | 2 | — | 22 | 21 |
| Silicate | 7.5 | 7.5 | 10 | — | — | 7.5 | 3.5 |
| Carbonate | 13 | 9 | 10 | 80 | 70 | 13 | 4.5 |
| Zeolite | — | 1.5 | — | — | — | — | — |
| DTPA | 0.9 | 0.9 | — | — | — | 0.9 | — |
| SOKALAN ® | 1.0 | 0.9 | — | — | — | 1.0 | — |
| PEI 1800 $E_7$ | — | — | — | — | — | — | — |
| CMC | 0.6 | 0.35 | — | — | — | 0.60 | 0.25 |
| SRA-1 | 0.2 | 0.2 | — | — | — | 0.2 | — |
| Protease/amylase | 0.36 | 0.54 | 0.3 | — | — | 0.36 | 0.5 |
| Cellulase | 007 | 0.07 | — | — | — | 0.07 | 0.1 |
| Lipase | — | — | 0.05 | — | — | — | — |
| Perborate | 4.10 | 1.35 | — | 4.0 | — | 2.25 | — |
| NOBS | 1.70 | 1.15 | — | — | — | 1.90 | — |
| TEAD | 0.6 | — | — | — | — | 0 | — |
| ZPS | 0.0015 | 0.007 | — | — | — | 0.0015 | — |
| Brighteners | 0.2 | 0.04 | 0.15 | — | — | 0.2 | 0.03 |
| Encapsulated HIA Perfume particle from Example 1 | 0.8 | 0.8 | 0.8 | 0.8 | 0.8 | 0.8 | 0.8 |
| Moisture + spray-on perfume | 6.0 | 5.6 | 8.9 | 6.0 | 5.9 | 6.0 | 6.0 |
| Sulfate | balance | balance | balance | balance | balance | balance | Balance |

What is claimed is:

1. An encapsulated perfume particle comprising:

a) a water-soluble modified starch solid matrix, wherein the modified starch comprises a starch raw material that has been modified by treatment of the starch raw material with octenyl-succinic acid anyhydride;

b) a perfume oil encapsulated by the solid matrix of the modified starch, comprising at least 40% by weight of at least 2 High Impact Accord ("HIA") perfume ingredients, each of said perfume ingredient having (1) a boiling point at 760 mm Hg, of 275° C. or lower, (2) a calculated CLogP of 2.0 or higher, and (3) an odor detection threshold ("ODT") less than or equal to 50 ppb and greater than 10 ppb; wherein the perfume particle begins to release the encapsulated perfume immediately upon addition to water.

2. An encapsulated perfume particle according to claim 1, wherein the perfume oil comprises at least 50%, of said HIA perfume ingredients.

3. An encapsulated perfume particle according to claim 1, wherein the perfume oil comprises at least 70% of said HIA perfume ingredients.

4. A granular detergent composition comprising:

I) from about 0.01% to about 50%, by weight, of an encapsulated perfume particle comprising;

(a) a water-soluble modified starch solid matrix;

(b) a perfume oil comprising at least 40% by weight of at least 2 High Impact Accord ("HIA") perfume ingredients, each said HIA perfume ingredient having (1) a boiling point at 760 mm Hg, of 275° C. or lower, (2) a calculated CLogP of 2.0 or higher, and (3) an odor detection threshold ("ODT") less than or equal to 50 ppb and greater than 10 ppb and;

II) from about 50% to about 99.99%, of conventional laundry ingredients selected from the group consisting of surfactants, builders, bleaching agents, enzymes, soil release polymers, dye transfer inhibitors, fillers, and mixtures thereof.

5. A granular detergent composition according to claim 4 wherein the composition comprises from about 0.05% to about 8.0%, by weight, of the encapsulated perfume particle, wherein the perfume oil comprises at least 50%, of said HIA perfume ingredients and from about 92% to about 99.95%, of said conventional laundry ingredients.

6. A granular detergent composition according to claim 4 wherein the composition comprises from about 0.05% to 3.0%, by weight, of the encapsulated perfume particle, wherein the perfume oil comprises at least 50% of said HIA perfume ingredients and from about 97% to about 99.95%, of said conventional laundry ingredients.

7. A granular detergent composition according to claim 4 wherein the composition comprises from about 0.05% to 1.0% by weight, of the encapsulated perfume particle, wherein the perfume oil comprises at least 50%, of said HIA perfume ingredients and from about 99% to about 99.95% of said conventional laundry ingredients.

8. A detergent composition according to claim 4 further comprising a perfume sprayed onto the surface of said detergent composition.

9. A detergent composition according to claim 5 further comprising a perfume sprayed onto the surface of said detergent composition.

10. A detergent composition according to claim 6 further comprising a perfume sprayed onto the surface of said detergent composition.

11. A detergent composition according to claim 7 further comprising a perfume sprayed onto the surface of said detergent composition.

* * * * *